United States Patent [19]

Brown, Jr.

[11] 4,053,865

[45] Oct. 11, 1977

[54] LINEAR MOTION COUPLING

[75] Inventor: Milton Reese Brown, Jr., Riverside, Calif.

[73] Assignee: Bourns, Inc., Riverside, Calif.

[21] Appl. No.: 679,114

[22] Filed: Apr. 22, 1976

[51] Int. Cl.[2] ..... H01C 10/40

[52] U.S. Cl. ..... 338/180; 338/176; 338/184

[58] Field of Search ..... 338/180–184, 338/160, 176; 74/470

[56] References Cited

U.S. PATENT DOCUMENTS

| | | | |
|---|---|---|---|
| 2,751,475 | 6/1956 | Gottschall | 338/183 X |
| 2,857,497 | 10/1958 | Bourns et al. | 338/183 |
| 2,902,663 | 9/1959 | Abatemarco et al. | 338/176 |
| 2,904,766 | 9/1959 | McMillan | 338/176 |
| 2,922,977 | 1/1960 | Gottschall | 338/183 |
| 2,940,059 | 6/1960 | Rehnborg | 338/183 |
| 3,250,144 | 5/1966 | Kansman | 74/470 |
| 3,364,454 | 1/1968 | Froebe | 338/176 |

*Primary Examiner*—C. L. Albritton

*Attorney, Agent, or Firm*—Paul H. Ware; William G. Becker

[57] ABSTRACT

A coupling between a linear motion drive shaft and a driven member, suitable for use in a linear motion potentiometer in which the driven member comprises a contact spring mounting block. An O-ring formed from a stiffly deformable, spring material is mounted on the drive shaft and held against a transverse wall on the driven member so as to absorb transverse and angular misalignments of the drive shaft and transmit to the driven member longitudinal drive shaft movements. The coupling exhibits low backlash when the motion of the drive shaft is reversed, and accommodates to both angular and transverse deviations of the shaft away from a linear drive orientation.

7 Claims, 4 Drawing Figures

LINEAR MOTION COUPLING

BACKGROUND OF THE INVENTION

This invention relates to couplings between a drive shaft and a driven member, and more particularly to a coupling between the drive shaft of a linear motion potentiometer and the mounting for the potentiometer contact spring.

Physical displacements are measured with a linear motion potentiometer by driving a contact spring along resistance and collector tracks housed in the potentiometer by an amount equal to the displacement sought to be measured. The voltage between the contact spring and one end of the element is measured to derive the location of the contact spring, and thereby the amount of displacement. The contact spring is carried by a mounting block, which in turn is moved by a drive shaft extending into the potentiometer parallel to the resistance and collector tracks. The drive shaft is coupled to the mounting block so that, as the shaft moves longitudinally into and out of the potentiometer housing, the contact spring assumes the correct position along the tracks.

In early designs the contact spring mounting was secured directly to the end of the drive shaft inside the potentiometer housing. This arrangement had the disadvantage that the drive shaft had to be precisely aligned with the resistance and collector tracks. A misalignment of the drive shaft from its ideal orientation could result in bending of the shaft, tilting of the contact spring mounting so that it did not ride smoothly through the device, and an uneven contact pressure between the spring and the resistance and collector tracks which increased wear on the spring and tracks at the high pressure areas and tended to make the potentiometer more susceptible to vibrational error at the low pressure areas.

Numerous attempts have been made to solve the problems associated with coupling the drive shaft directly to the contact spring mounting. For example, in U.S. Pat. No. 3,364,454 to Froebe, issued Jan. 16, 1968, the drive shaft extends through the spring mounting. Pivot washers are located between opposite surfaces of the mounting and end flanges or nuts on the shaft. The pivot washers, typically formed from stainless steel with diametrically protruding line contact regions or edges, permit the shaft to pivot away from an orientation parallel to the resistance and collector tracks. A similar approach is taken in U.S. Pat. No. 2,857,497 to M. E. Bourns and E. J. Goeppinger, issued Oct. 21, 1958. In this patent wavy spring washers are interposed between the drive shaft and opposite sides of a wall on the spring mounting, again for the purpose of accommodating misalignments between the drive shaft and spring mounting. In U.S. Pat. No. 2,904,766 to J. C. McMillan, issued Sept. 15, 1959, the drive shaft extends through the mounting and is coupled to the mounting on the near side by a spring loaded washer and on the far side by a ball and socket engagement which again permits limited angular movement of the shaft. Another prior art patent, U.S. Pat. No. 3,250,144 to H. R. Kansman, issued May 10, 1966, discloses a vibration damping coupling intended for a motor vehicle acceleration linkage in which some of the problems faced were similar to those for a linear motion potentiometer. In this patent the drive and driven members are coaxial and separated by an elastomer bushing which is bonded at its outer and inner surfaces to each of the members respectively. The elastomer bushing couples the accelerator pedal to the throttle valve with sufficient resilience in shear to dampen vibrations from the engine and isolate them from the accelerator pedal.

While each of the above devices provides a coupling between a drive shaft and a driven member that permits a limited amount of angular drive shaft movement, they are also subject to some degree of improvement. Metal washers, for example, tend to lose their resiliency after being overstressed and thereafter lose their previous intimate connection between a shaft and spring mounting. Also, it is difficult to adjust to transverse movements of the shaft, since the washers have not been found to move well in a direction transverse to the drive shaft. This latter problem is even more severe with ball and socket type couplings and the elastomer bushing coupling described above. Another serious disadvantage associated in varying degrees with the prior art couplings is that of backlash, i.e., when the drive shaft reverses its direction the spring mounting does not follow the shaft movement precisely. As a result the contact spring may not return to the same location along the tracks when the shaft is moved away from and then brought back to an initial position. This produces an inconsistency between the electrical output signal and the actual position of the shaft.

Of course, it is always desirable that a device be as simple and economical as possible while satisfying its intended functions. In this regard the various prior art devices are all subject to some simplification.

SUMMARY OF THE INVENTION

In view of these and other problems associated with the prior art, an object of the present invention is the provision of a novel and improved mechanism for coupling a drive shaft with a driven member such as the contact spring of a linear motion potentiometer.

Another object is the provision of such a coupling mechanism that can accommodate both angular and transverse drive shaft movements without degrading the transfer of longitudinal movements from the drive shaft to the driven member.

Still another object is the provision of such a coupling which exhibits little or no backlash when the drive direction is reversed.

A further object is the provision of a vibration damping coupling mechanism.

Yet another object is the provision of a coupling mechanism having a simple, inexpensive construction.

These and other objects are satisfied in the present invention by means of a simple but novel construction in which an O-ring formed from a stiffly deformable, springy material is held on the drive shaft and couples the shaft to a driven member such as a mounting means for the contact spring of a linear motion potentiometer. The O-ring absorbs transverse and angular drive shaft movements while transmitting longitudinal drive shaft movements to the mounting member. In a preferred embodiment the driven member includes a bore for receiving the shaft and a slot transversely intersecting the bore for receiving the O-ring, which is positioned in the slot encircling the shaft. A means such as a washer seated in an annular groove around the shaft retains the shaft in the bore and the O-ring on the shaft in contact with a transverse wall of the driven member.

DESCRIPTION OF A PREFERRED EMBODIMENT

Figure 1:
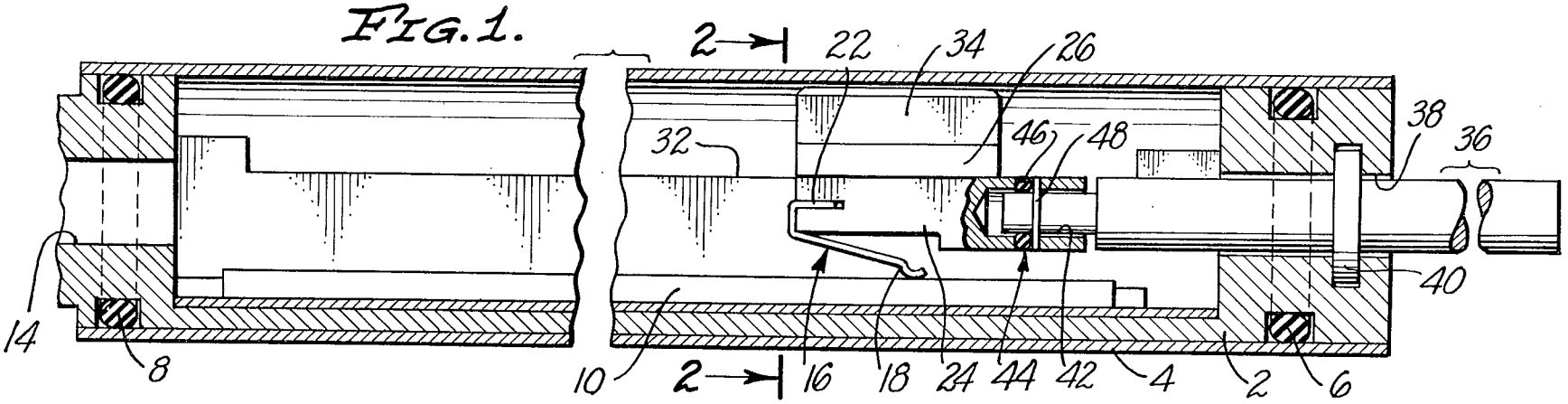
FIG. 1 is a sectional view showing a linear motion potentiometer which embodies the present invention.
Figure 2:
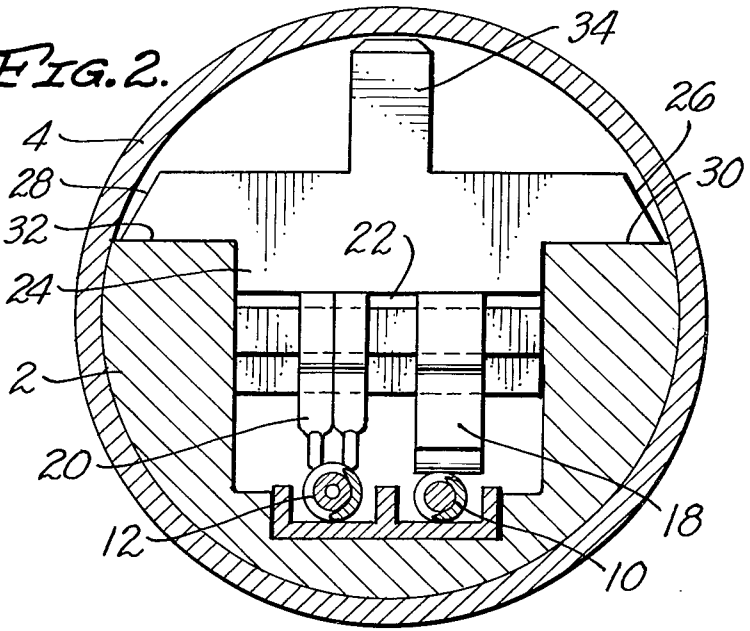
FIG. 2 is a sectional view taken along the lines 2—2 of FIG. 1.

Referring to FIGS. 1 and 2, a linear motion potentiometer (LMP) is shown having a housing formed by a body portion 2 and an outer cylindrical casing 4. Elastomeric O-rings 6 and 8 are seated in annular grooves at each end of body portion 2 and are compressed therein by casing 4 so as to seal the interior of the housing. Suitable fastening means, not shown, are provided to keep casing 4 in place. Secured to the floor of body portion 2 and extending longitudinally thereon are resistance and collector tracks 10 and 12, respectively. Resistance track 10 has a coating or wound layer of a suitable resistance material, while collector track 12 is formed from an electrically conductive material. Lead wires associated with each of the tracks enter the housing through a sealed opening 14 at one end.

An electrical connection between resistance and collector tracks 10 and 12 is made by an electrically conductive contact spring 16 having a pair of depending wiper fingers 18 and 20 which wipe respectively against the resistance and collector tracks. An upper tab 22 on the contact spring is bent to fit into a slot on a mounting block 24 so that the spring is secured to the block with fingers 18 and 20 flexed against their respective tracks. Wing sections 26 and 28 on either side of mounting block 24 rest on platforms 30 and 32, which platforms extend longitudinally along each side of the interior of body portion 2 and serve as a guide for longitudinal movement of the mounting block. Upward movement of the mounting block is limited by a member 34 which projects upwardly from the block and terminates near the inner surface of casing 4.

The position of contact spring 16, which electrically bridges resistance track 10 and collector track 12, determines the electrical output of the device. Movement of the contact spring is controlled by a drive shaft 36 which extends into the housing through a bore 38 at the end of body portion 2. A gasket 40 lodged in the body portion surrounding shaft 36 provides a seal for the housing.

Figure 3:
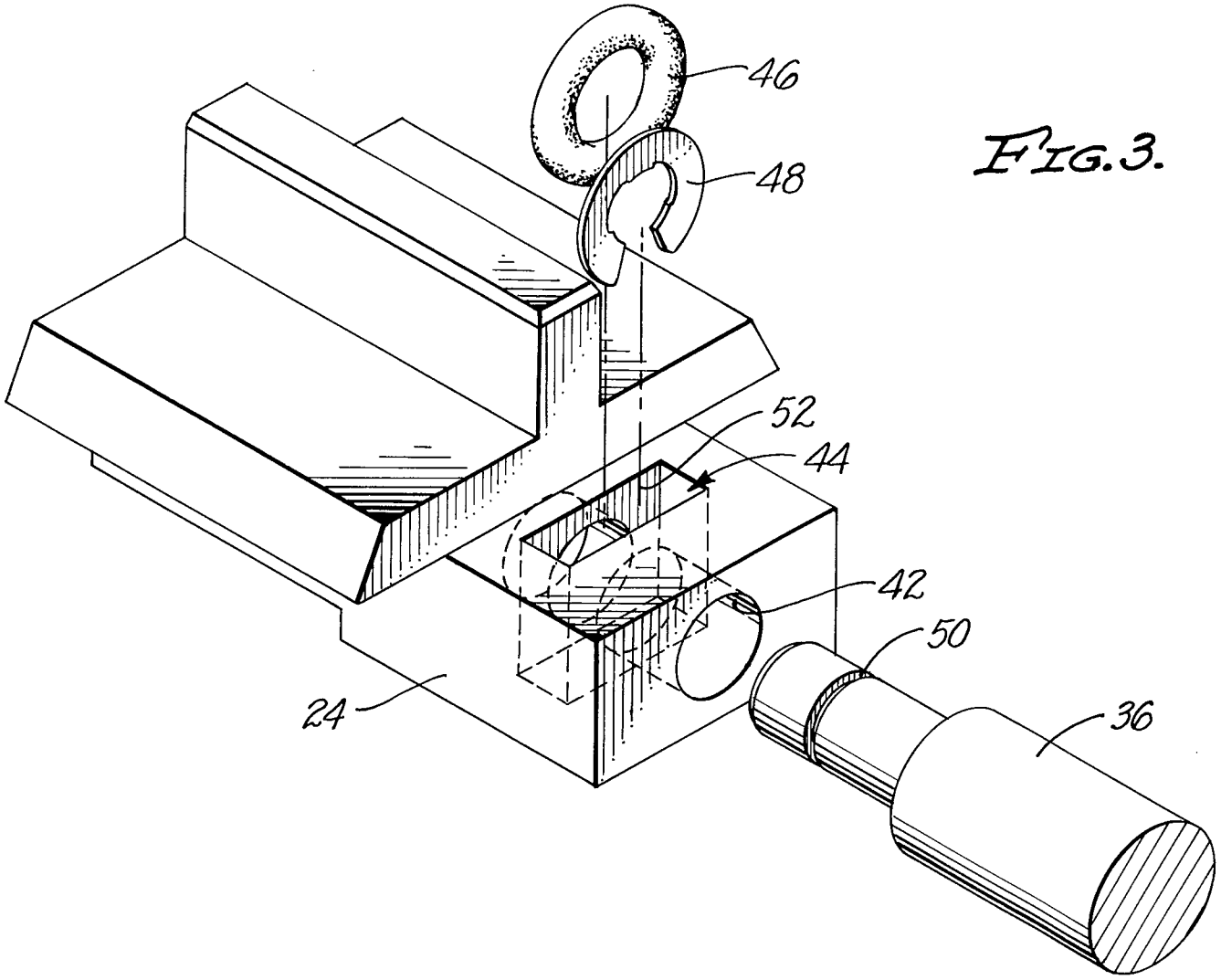
FIG. 3 is an exploded view in perspective showing the components of the coupling mechanism.

The LMP as described thus far can be of conventional construction. The novel feature of the present invention concerns the coupling mechanism between drive shaft 36 and contact spring 16. This mechanism is shown in FIG. 1 and in exploded perspective in FIG. 3. A bore 42 having a diameter greater than the inner end of shaft 36 is formed in mounting block 24 to receive the inner shaft end. A slot 44 is cut through the mounting block in a direction transverse to bore 42 and shaft 36 such that it intersects and is centered about the bore. The inner end of shaft 36 is lodged in bore 42 and is encircled by an O-ring 46 positioned in slot 44. O-ring 46 is formed from a stiffly deformable, springy material such as the flourocarbon elastomer produced by the E. I. Du Pont de Nemours Company under the registered trademark VITON. A washer such as C-ring 48 is seated within slot 44 in an annular groove 50 on shaft 36 to retain the shaft in the mounting block. Slot 44 is no wider than the combined widths of O-ring 46 and C-ring 48 and is preferably slightly smaller so that O-ring 46 is slightly compressed by C-ring 48 against one of the transverse slot walls 52.

The coupling is readily assembled by first inserting O-ring 46 into slot 44 and centering it about bore 42 (this is facilitated by having the outside diameter of O-ring 46 substantially equal to the depth of slot 44), inserting shaft 36 into the bore through O-ring 46 until groove 50 enters the slot, and then pushing C-ring 48 down over the shaft until it snaps into the groove.

The resulting coupling, although quite simple in construction, has several advantages over the prior art. O-ring 46 substantially absorbs both angular and transverse movements of the drive shaft without tilting or misaligning mounting block 24. As a result both the frictional drag on mounting block 24 and the wear between contact spring 16 and the resistance and collector tracks are kept within acceptable levels, even if the drive shaft is misaligned. Because of its high resiliency, O-ring 46 recovers its original shape after being subjected to shaft misalignments, unlike some prior metal coupling devices which could be overstressed and thereafter fail to return to their original shape. A further important advantage of the present invention is that it produces a very low level of backlash, i.e., when the drive shaft is moved away from and returned to an initial position, the contact spring also returns to the same initial position. This feature is attributed to the spring-like qualities of the O-ring while under compression.

Figure 4:
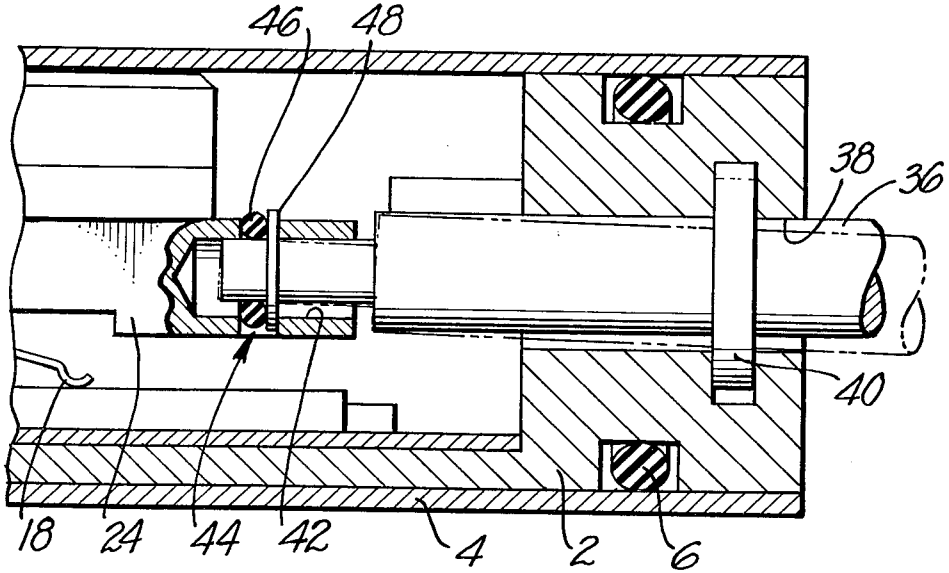
FIG. 4 is an enlarged view of a portion of a linear motion potentiometer illustrating the manner in which the coupling mechanism of the present invention accommodates to misalignment of the drive shaft.

Referring to FIG. 4, two typical drive shaft misalignments and the accommodation of the coupling mechanism to them are shown. Drive shaft 36 is shown in solid lines as being transversely misaligned, i.e., its axis is shifted vertically upward from its normal position coaxial to bores 38 and 42. In this situation O-ring 46 and C-ring 48 also shift transversely within slot 44, their smooth surfaces providing a relatively low amount of friction with the transverse slot walls. Gasket 40 also slides upward by the same amount or, alternatively, it can be formed from a flexible material that accommodates to the transverse movement without an overall shifting of the gasket. Mounting block 24 thus maintains the same position relative to resistor and collector tracks 10 and 12 even though the position of drive shaft 36 has been altered. The drive shaft is shown as having an angular misalignment in dashed lines, tilting down and to the right. In this case O-ring 46 is compressed, particularly along its bottom area, and absorbs the angular stress that would otherwise be transmitted to mounting block 24 as a clockwise torque. Mounting block 24 is again preserved against unwanted stresses that could cause its performance to suffer. In each of the above misalignment situations, drive shaft 36 can be moved longitudinally in and out of the LMP housing in substantially the same manner as if it was perfectly aligned with mounting block 24.

While a particular embodiment of the invention has been shown and described, numerous additional modifications and variations are possible in light of the above teachings. It is therefore intended that the scope of the invention be limited only in and by the terms of the appended claims.

What is claimed is:

1. In a linear motion potentiometer which includes a housing, resistance and collector tracks extending along the inside of said housing, a contact spring electrically and mechanically bridging said resistance and collector tracks, and a drive shaft extending inwardly into said housing for moving said contact spring in longitudinal, reciprocable wiping contact along said resistance and collector tracks, wherein the improvement comprises low backlash means for coupling said drive shaft to said contact spring, said means comprising:

a mounting means for said contact spring, said mounting means including a bore for receiving said drive shaft and a slot transversely intersecting said bore for receiving an O-ring, said O-ring being positioned in said slot encircling said drive shaft and said O-ring being formed from a stiffly deformable, springy material and coupling said drive shaft to said mounting means so as to absorb transverse and angular movements of said drive shaft and transmit to said mounting means longitudinal drive shaft movement.

2. In a linear motion potentiometer which includes a housing, resistance and collector tracks extending along the inside of said housing, a contact spring electrically and mechanically bridging said resistance and collector tracks, and a drive shaft extending inwardly into said housing for moving said contact spring in longitudinal, reciprocable wiping contact along said resistance and collector tracks, wherein the improvement comprises low backlash means for coupling said drive shaft to said contact spring, said means comprising:

a mounting means for said contact spring, said mounting means including a bore for receiving said drive shaft and a slot transversely intersecting said bore for receiving an O-ring, said O-ring being positioned in said slot encircling said drive shaft and said O-ring being formed from a stiffly deformable, springy material and coupling said drive shaft to said mounting means so as to absorb transverse and angular movements of said drive shaft and transmit to said mounting means longitudinal drive shaft movement and including means projecting from said drive shaft within said slot to retain said drive shaft in said bore, said O-ring being compressed by said projecting means against a transverse wall of said slot and being substantially immoveably held between said projecting means and said transverse wall of said slot.

3. In a linear motion potentiometer which includes a housing, resistance and collector tracks extending along the inside of said housing, a contact spring electrically and mechanically bridging said resistance and collector tracks, and a drive shaft extending inwardly into said housing for moving said contact spring in longitudinal, reciprocable wiping contact along said resistance and collector tracks, wherein the improvement comprises low backlash means for coupling said drive shaft to said contact spring, said means comprising:

a mounting means for said contact spring, said mounting means including a bore for receiving said drive shaft and a slot transversely intersecting said bore for receiving an O-ring, said O-ring being positioned in said slot encircling said drive shaft and said O-ring being formed from a stiffly deformable, springy material and coupling said drive shaft to said mounting means so as to absorb transverse and angular movements of said drive shaft and transmit to said mounting means longitudinal drive shaft movement and including means projecting from said drive shaft within said slot to retain said drive shaft in said bore, said O-ring being compressed by said projecting means against a transverse wall of said slot and being substantially immoveably held between said projecting means and said transverse wall of said slot and wherein said projecting means comprises a washer seated in an annular groove around said shaft.

4. In a linear motion potentiometer which includes a housing, resistance and collector tracks extending along the inside of said housing, a contact spring electrically and mechanically bridging said resistance and collector tracks, and a drive shaft extending inwardly into said housing for moving said contact spring in longitudinal, reciprocable wiping contact along said resistance and collector tracks, wherein the improvement comprises low backlash means for coupling said drive shaft to said contact spring, said means comprising:

a mounting means for said contact spring, said mounting means including a bore for receiving said drive shaft and a slot transversely intersecting said bore for receiving an O-ring, said O-ring being positioned in said slot encircling said drive shaft and said O-ring being formed from a stiffly deformable, springy material and coupling said drive shaft to said mounting means so as to absorb transverse and angular movements of said drive shaft and transmit to said mounting means longitudinal drive shaft movement and wherein said slot extends inwardly from an exterior surface of said mounting means, thereby enabling an assembly procedure in which said O-ring is inserted into said slot in alignment with said bore and said drive shaft is thereafter inserted into said bore through said O-ring.

5. In a linear motion potentiometer which includes a housing, resistance and collector tracks extending along the inside of said housing, a contact spring electrically and mechanically bridging said resistance and collector tracks, and a drive shaft extending inwardly into said housing for moving said contact spring in longitudinal, reciprocable wiping contact along said resistance and collector tracks, wherein the improvement comprises low backlash means for coupling said drive shaft to said contact spring, said means comprising:

a mounting means for said contact spring, said mounting means including a bore for receiving said drive shaft and a slot transversely intersecting said bore for receiving an O-ring, said O-ring being positioned in said slot encircling said drive shaft and said O-ring being formed from a stiffly deformable, springy material and coupling said drive shaft to said mounting means so as to absorb transverse and angular movements of said drive shaft and transmit to said mounting means longitudinal drive shaft movement and wherein said slot extends inwardly from an exterior surface of said mounting means, thereby enabling an assembly procedure in which said O-ring is inserted into said slot in alignment with said bore and said drive shaft is thereafter inserted into said bore through said O-ring and wherein the diameter of said bore is greater than the drive shaft diameter, thereby permitting angular movements of said drive shaft which are substantially absorbed by said O-ring, and wherein said slot is sufficiently large so as to accommodate transverse movements of said drive shaft and O-ring, and said potentiometer housing includes a sealing gasket for said drive shaft which is also adapted to accommodate transverse movements of said drive shaft.

6. Means for coupling a drive shaft to a driven member for reciprocating linear movement with low backlash upon reversing the direction of drive movement, said driven member having a wall substantially transverse to the axis of said drive shaft and including a bore and a slot transversely intersecting said bore, wherein said drive shaft is received in said bore and an O-ring and retaining means are lodged in said slot and wherein said O-ring is formed from a stiffly deformable, springy material mounted on and encircling said drive shaft, and including means associated with said drive shaft for retaining said O-ring on said shaft in contact with said transverse driven member wall.

7. Means for coupling a drive shaft to a driven member for reciprocating linear movement with low backlash upon reversing the direction of drive movement, said driven member having a wall substantially transverse to the axis of said drive shaft and including a bore and a slot transversely intersecting said bore, wherein said drive shaft is received in said bore and an O-ring and retaining means are lodged in said slot and wherein said O-ring is formed from a stiffly deformable, springy material mounted on and encircling said drive shaft, and including means associated with said drive shaft for retaining said O-ring on said shaft in contact with said transverse driven member wall and wherein said retaining means comprises a washer seated in an annular groove around said shaft adjacent to said O-ring, said washer holding said O-ring against a transverse wall of said slot.

* * * * *